US012638204B2

(12) United States Patent
Lehman et al.

(10) Patent No.: US 12,638,204 B2
(45) Date of Patent: May 26, 2026

(54) CLOUD-BASED HVAC AND R CONTROL SYSTEMS AND METHODS

(71) Applicant: Johnson Controls Tyco IP Holdings LLP, Milwaukee, WI (US)

(72) Inventors: Delmar Eugene Lehman, Chambersburg, PA (US); Joseph Milton Long, Greencastle, PA (US); Corey Charles Peregord, Waynesboro, PA (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 434 days.

(21) Appl. No.: 18/014,714

(22) PCT Filed: Jul. 6, 2021

(86) PCT No.: PCT/US2021/040534

§ 371 (c)(1),
(2) Date: Jan. 5, 2023

(87) PCT Pub. No.: WO2022/010913

PCT Pub. Date: Jan. 13, 2022

(65) Prior Publication Data

US 2023/0296276 A1 Sep. 21, 2023

Related U.S. Application Data

(60) Provisional application No. 63/048,576, filed on Jul. 6, 2020.

(51) Int. Cl.
*F24F 11/58* (2018.01)
*F24F 11/65* (2018.01)

(52) U.S. Cl.
CPC ..... *F24F 11/58* (2018.01); *F24F 11/65* (2018.01)

(58) Field of Classification Search
CPC .. F24F 11/58; F24F 11/65; F24F 11/50; F24F 2140/00
See application file for complete search history.

(56) References Cited

U.S. PATENT DOCUMENTS 5,706,190 A * 1/1998 Russ ..... G01D 4/004 165/205
9,244,471 B2 1/2016 Watts et al.
(Continued)

FOREIGN PATENT DOCUMENTS

JP 6350801 B2 7/2018
KR 20150005746 A 1/2015
(Continued)

OTHER PUBLICATIONS

European Extended Search Report for EP Application No. 21837662.2, dated May 31, 2024, 8 pages.
(Continued)

*Primary Examiner* — Mohammad Ali
*Assistant Examiner* — Vincent W Chang
(74) *Attorney, Agent, or Firm* — Fletcher Yoder, P.C.

(57) ABSTRACT

A heating, ventilation, air conditioning, and/or refrigeration (HVAC&R) system includes one or more sensors configured to acquire feedback indicative of an operational parameter of a component of the HVAC&R system. The HVAC&R system includes a control unit of the component that is configured to receive the feedback from the one or more sensors. The control unit is configured to analyze the feedback in accordance with a first control scheme to generate a first control output and to operate the component based on the first control output. The HVAC&R system includes a remote server configured to provide a cloud computing environment, where the remote server is communicatively coupled to the control unit via a network. The remote server is configured to receive and analyze the feedback in accor-
(Continued)

dance with a second control scheme to generate a second control output and to operate the component based on the second control output.

20 Claims, 3 Drawing Sheets

(56) References Cited

U.S. PATENT DOCUMENTS

| | | | | |
|---|---|---|---|---|
| 10,473,351 | B2 | 11/2019 | Anderson et al. | |
| 10,627,126 | B2 | 4/2020 | Ribbich et al. | |
| 2009/0140064 | A1 | 6/2009 | Schultz et al. | |
| 2012/0233478 | A1* | 9/2012 | Mucignat | H04W 52/0277 713/320 |
| 2013/0310986 | A1* | 11/2013 | Gust | F24F 11/62 700/276 |
| 2014/0031992 | A1* | 1/2014 | Bergman | F24F 11/30 700/276 |
| 2014/0074730 | A1 | 3/2014 | Arensmeier et al. | |
| 2014/0148969 | A1* | 5/2014 | Graziano | G05D 23/1905 700/300 |
| 2014/0358294 | A1* | 12/2014 | Nichols | F24F 11/64 700/278 |
| 2015/0045959 | A1* | 2/2015 | McPherson | G05D 23/1905 700/276 |
| 2015/0236892 | A1* | 8/2015 | Zhao | H04L 41/06 709/224 |
| 2016/0274552 | A1 | 9/2016 | Strohmenger et al. | |
| 2016/0290672 | A1* | 10/2016 | Arensmeier | F24F 11/62 |
| 2017/0343967 | A1 | 11/2017 | Verma | |
| 2018/0052451 | A1 | 2/2018 | Billi-Duran et al. | |
| 2018/0225244 | A1 | 8/2018 | Dorneanu et al. | |
| 2019/0331357 | A1* | 10/2019 | Rogerson | C09D 139/06 |
| 2020/0370773 | A1* | 11/2020 | Li | G05B 13/048 |
| 2025/0189157 | A1* | 6/2025 | Goldenson | G08B 21/14 |

FOREIGN PATENT DOCUMENTS

| | | | |
|---|---|---|---|
| KR | 20150122947 | A | 11/2015 |
| KR | 20160122572 | A | 10/2016 |

OTHER PUBLICATIONS

Korean Office Action for KR Application No. 10-2023-7004277, dated Sep. 19, 2024, 8 pages.

PCT International Search Report and Written Opinion for PCT Application No. PCT/US2021/040534, mailed Oct. 29, 2021, 11 pgs.

Frick Industrial Refrigeration, "Quantum HD: Heavy Duty Performance in High Definition," Form 090.040-SG1, Apr. 2017, 8 pages.

GEA, "Technical Information: GEA Omni Control Panel," E_801050_6, Sep. 8, 2019, 60 pages.

Emerson, "Vission 20/20 micro-controller," Operation and service manual, Version 2.6, Sep. 2016, 341 pages.

Mayekawa, "Mayekawa New Refrigeration System Controler: MYPRO Touch," Apr. 2014, 4 pages.

* cited by examiner

CLOUD-BASED HVAC AND R CONTROL SYSTEMS AND METHODS

CROSS-REFERENCE TO RELATED APPLICATIONS

This application is a U.S. National Stage Application of PCT International Application No. PCT/US2021/040534, entitled "CLOUD-BASED HVAC&R CONTROL SYSTEMS AND METHODS," filed Jul. 6, 2021, which claims priority to and the benefit of U.S. Provisional Application No. 63/048,576, entitled "CLOUD-BASED HVAC&R CONTROL SYSTEMS AND METHODS," filed Jul. 6, 2020, each of which is hereby incorporated by reference in its entirety for all purposes.

BACKGROUND

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Heating, ventilation, air conditioning, and/or refrigeration (HVAC&R) systems typically maintain temperature control in a structure or other controlled space by circulating a fluid (e.g., refrigerant) through a circuit via a compressor to exchange thermal energy with another fluid (e.g., water and/or air). The compressor may include a screw compressor, a centrifugal compressor, or another suitable compressor for circulating the fluid through the circuit and between various components (e.g., heat exchangers) of the HVAC&R system. Generally, a control panel is utilized with the compressor to control operation of the compressor based on feedback acquired by sensors of the HVAC&R system. Unfortunately, existing control panels may be ill-equipped to effectively analyze the sensor feedback and, therefore, may control the compressor in a manner that limits or reduces an optimum operational efficiency of the compressor.

SUMMARY

Certain embodiments commensurate in scope with the present disclosure are summarized below. These embodiments are not intended to limit the scope of the disclosure, but rather these embodiments are intended only to provide a brief summary of possible forms of present embodiments. Indeed, present embodiments may encompass a variety of forms that may be similar to or different from the embodiments set forth below.

In some embodiments, a heating, ventilation, air conditioning, and/or refrigeration (HVAC&R) system includes one or more sensors configured to acquire feedback indicative of an operational parameter of a component of the HVAC&R system. The HVAC&R system also includes a control unit of the component that is configured to receive the feedback from the one or more sensors. The control unit is configured to analyze the feedback in accordance with a first control scheme to generate a first control output and to operate the component based on the first control output. The HVAC&R system further includes a remote server configured to provide a cloud computing environment, where the remote server is communicatively coupled to the control unit via a network. The remote server is also configured to receive and analyze the feedback in accordance with a second control scheme to generate a second control output and to operate the component based on the second control output.

In some embodiments, a method for operating a heating, ventilation, air conditioning, and/or refrigeration (HVAC&R) system includes acquiring feedback indicative of an operational parameter of a component of the HVAC&R system via one or more sensors of the HVAC&R system. The method also includes determining whether to control the component in accordance with a first control scheme or a second control scheme based on a status of a communication channel between a control unit of the component and a remote server of the HVAC&R system. The method further includes, in response to determining that the communication channel between the control unit and the remote server is interrupted, analyzing the feedback via the control unit and in accordance with the first control scheme to generate a first control output for operating the component. The method also includes, in response to determining that the communication channel between the control unit and the remote server is established, analyzing the feedback via the remote server and in accordance with the second control scheme to generate a second control output for operating the component.

In some embodiments, a heating, ventilation, air conditioning, and/or refrigeration (HVAC&R) system includes a plurality of control units configured to control operation of respective components of a plurality of components of the HVAC&R system. The plurality of control units is configured to receive sensor feedback and analyze the sensor feedback in accordance with respective first control schemes to generate respective first control outputs for controlling the respective components. The HVAC&R system also includes a remote server configured to provide a cloud computing environment. The remote server is configured to communicatively couple to the plurality of control units via a network. The remote server is also configured to receive the sensor feedback and analyze the sensor feedback in accordance with a second control scheme to generate a second control output for controlling at least one component of the plurality of components.

DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
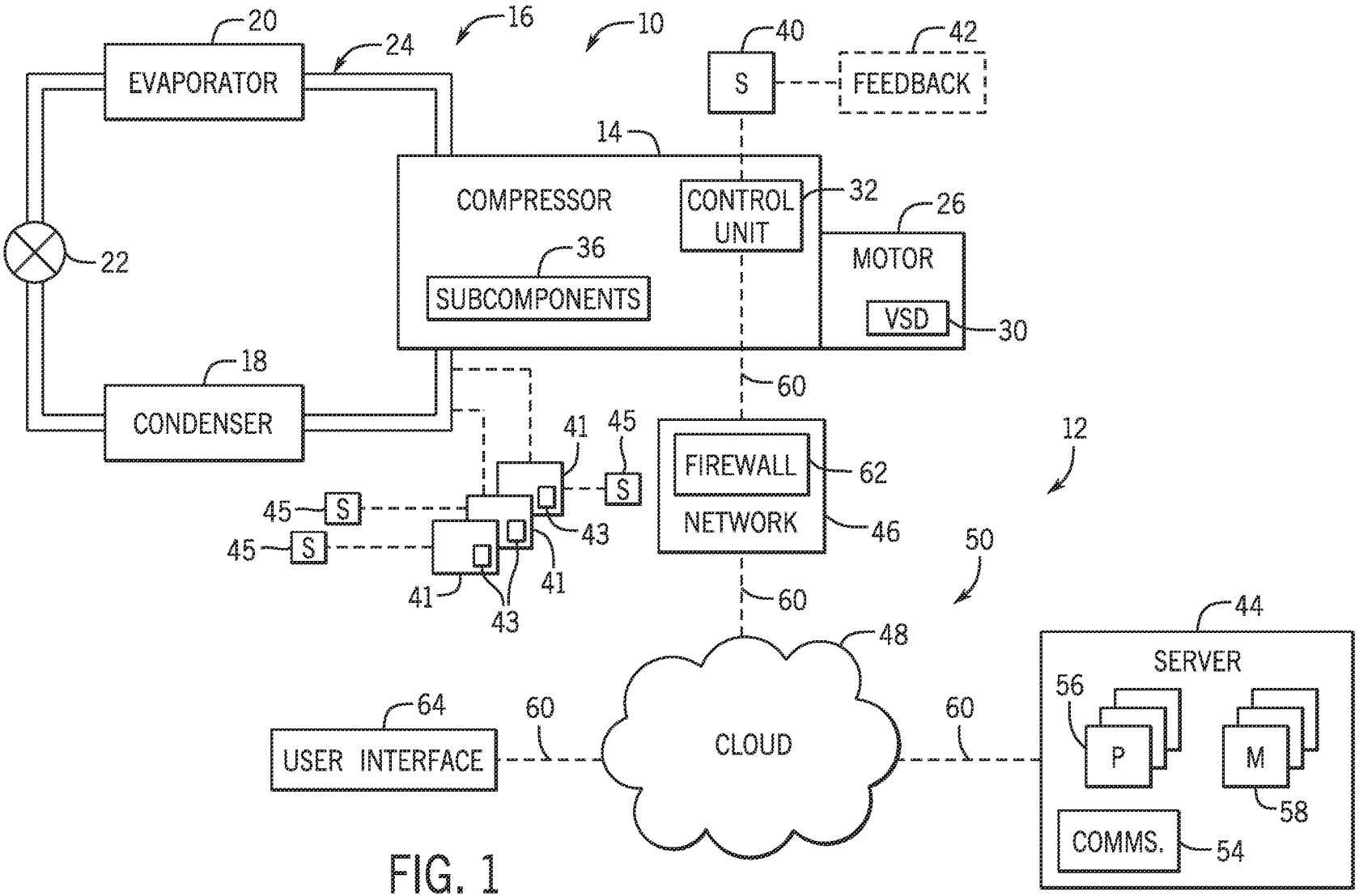
FIG. 1 is a schematic of an embodiment of a heating, ventilation, air conditioning, and/or refrigeration (HVAC&R) system having a cloud-based HVAC&R control system, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

A heating, ventilation, air conditioning, and/or refrigeration (HVAC&R) system may include a vapor compression system having a compressor (e.g., a screw compressor, a centrifugal compressor) that is configured to circulate a fluid through piping or conduits of the vapor compression system. For example, the compressor may draw a relatively low pressure vapor flow (e.g., a flow of refrigerant) through a compressor inlet and discharge the vapor flow at a relatively high pressure through a compressor outlet. As such, the compressor facilitates fluid circulation through the vapor compression system. For example, the compressor may be used to circulate a fluid between a condenser and an evaporator of the HVAC&R system.

Generally, various components of the HVAC&R system, such as the compressor, include a dedicated control panel that is configured to control various operational parameters of the components. For example, the compressor typically includes a control panel that is implemented with (e.g., coupled to) the compressor and is configured to control various operations of the compressor based on sensor feedback (e.g., data) received from one or more sensors of the HVAC&R system. For example, the sensors may be communicatively coupled to the control panel and configured to provide the control panel with feedback indicative of operational parameters of the compressor and/or of other components included in the vapor compression system having the compressor. The control panel typically includes a memory that stores processor-executable routines, processes, and/or commands (e.g., software code, compressor control algorithms) and a processor configured to run the routines. The processor may execute the routines to analyze the sensor data and, based on results of such analysis, adjust certain operational parameters of the compressor (e.g., a compressor speed, a compressor capacity, another suitable compressor parameter).

Unfortunately, the manufacture of dedicated control panels for individual components of the HVAC&R system (e.g., individual compressors) may complicate production and increase manufacturing costs of the components. Moreover, typical compressor control panels may have limited processing power for analyzing sensor feedback that may be acquired by the sensors of the HVAC&R system. That is, the control panels may lack sufficient computational resources (e.g., processing power) to execute advanced compressor control algorithms that enable advanced evaluation of the collected sensor feedback and enhanced compressor control based thereon. Accordingly, conventional compressor control panels may be susceptible to operating the compressors at limited or reduced operational efficiencies. Further, it may be tedious and time consuming to update or modify the control routines stored in the respective control panels of a plurality compressors. For example, updating the control routines of a plurality of compressors may involve a human operator traveling to a location of each of the compressors and manually installing software updates on corresponding control panels of the compressors (e.g., using a portable device, such as a laptop or other memory device).

It is now recognized that utilizing a cloud-based HVAC&R control system to control some of or all of the operational aspects of a compressor enables a traditional compressor control panel to be replaced with a simplified and more economical control unit that utilizes fewer processing components (e.g., hardware components, software modules) than the traditional control panel. That is, it is recognized that offloading compressor control functionality from a traditional compressor control panel to a cloud-based HVAC&R control system enables effective compressor operation using fewer integrated control circuitry features in the compressor. As such, the cloud-based HVAC&R control system may reduce a manufacturing cost and/or a manufacturing complexity associated with producing individual compressors.

Moreover, it is now recognized that utilizing a cloud-based HVAC&R control system enables compressor control in accordance with complex compressor control algorithms that, when executed, enhance an operational efficiency of the compressor (e.g., as compared to an operational efficiency of the compressor that may be achieved when controlling the compressor using conventional compressor control panels). Specifically, it is recognized that, via implementation of the cloud-based HVAC&R control system, more powerful computing resources may be used to execute advanced compressor control algorithms that increase compressor efficiency and are otherwise ill-suited for implementation with traditional compressor control panels (e.g., due to limited computational resources available on such control panels).

Additionally, it is now recognized that a single cloud-based HVAC&R control system may be used to monitor and control operation of a plurality of compressors. As such, an operator may utilize the cloud-based HVAC&R control system to implement software updates across multiple compressors without physically traveling to each of the compressors to manually adjust or modify the control algorithms at sites of the corresponding control panels of the compressors. Accordingly, the cloud-based HVAC&R control system may reduce a time period involved for performing maintenance on the compressors and/or may reduce maintenance costs associated with operating the compressors.

Accordingly, embodiments of the present disclosure are directed toward a cloud-based HVAC&R control system for more efficiently controlling operation of one or more compressors and/or of other suitable components of the HVAC&R system. The cloud-based HVAC&R control system includes a server, or a plurality of servers (e.g., cloud servers), which may be located remotely from the compressor and is configured to monitor, control, or otherwise adjust operational parameters of the compressor and/or of other components of the vapor compression system having the compressor. For example, the remote servers are configured to provide a cloud computing environment, referred to herein as a "cloud," for storage and/or analysis of sensor feedback that may be acquired by sensors of the compressor and/or by sensors of the vapor compression system. The remote servers enable execution of complex compressor control algorithms in the cloud that may be used to analyze sensor data relevant to operation of the compressor and to generate control outputs (e.g., control signals) for controlling operation of the compressor based on results of such analysis. For clarity, as used herein, discussions relating to processing data, storing data, forming control outputs, or performing other operations "in the cloud" or by a "cloud computing environment" are intended to denote computational operations that may be performed by the one or more servers configured to provide the cloud-based computational environment. That is, as used herein, computational operations discussed as being performed "in the cloud" or by a "cloud computing environment" may refer to computational operations that are performed partially or completely by the cloud servers that are remotely located, instead of by processing components integrated with the compressor (e.g., such as processing components included on the control unit of the compressor).

In some embodiments, the cloud-based HVAC&R control system and the control unit of the compressor may cooperatively control certain aspects of the compressor. In other embodiments, the control unit of the compressor may be idle (e.g., in a hibernating state, in a non-operational state) while the cloud-based HVAC&R control system controls substantially all compressor operations. In such embodiments, the control unit may be configured to assume control of the compressor at designed operational periods of the compressor (e.g., such as when a communication channel or communication connection between the control unit and the cloud-based HVAC&R control system is temporarily interrupted). In any case, as discussed in detail below, the cloud-based HVAC&R control system may enable more efficient compressor operation while mitigating the aforementioned short comings of traditional compressor control panels that may be utilized with conventional compressors. Moreover, as briefly noted above and discussed in further detail herein, the cloud-based HVAC&R control system may be used to control a variety of other components of the HVAC&R system in accordance with the disclosed techniques.

Turning now to the drawings, FIG. 1 is a schematic of an embodiment of an HVAC&R system 10 that includes a cloud-based HVAC&R control system 12 for monitoring and controlling operation of one or more components of the HVAC&R system 10, such as a compressor 14. The HVAC&R system 10 includes a vapor compression system 16 (e.g., a refrigeration system) having a condenser 18, an evaporator 20, an expansion device 22 (e.g., an electronic expansion valve), and the compressor 14, which are fluidly coupled to one another via conduits (e.g., pipes) to form a circuit 24 (e.g., a refrigerant circuit). The compressor 14 includes a motor 26 that is configured to drive operation of the compressor 14. To this end, the motor 26 enables the compressor 14 to circulate a fluid (e.g., a refrigerant) through the circuit 24. Accordingly, the compressor 14 may facilitate heat transfer between the evaporator 20 and the condenser 18.

In some embodiments, the motor 26 may be powered by a variable speed drive (VSD) 30. The VSD 30 receives alternating current (AC) power having a particular fixed line voltage and fixed line frequency from an AC power source and provides power having a variable voltage and frequency to the motor 26. In other embodiments, the motor 26 may be powered directly from an AC or direct current (DC) power source. The motor 26 may include any type of electric motor that can be powered by the VSD 30 or directly from an AC or DC power source, such as a switched reluctance motor, an induction motor, an electronically commutated permanent magnet motor, or another suitable motor.

In the illustrated embodiment, the compressor 14 includes a control unit 32 that, as discussed in detail below, may be configured to monitor and/or adjust certain operational parameters of the compressor 14. The control unit 32 may be coupled to a structure of the compressor 32, such as a housing and/or frame of the compressor 32. The control unit 32 may be configured to send instructions to the VSD 30 to adjust a speed of the motor 26 and/or to send instructions for adjusting operational parameters of various other compressor components 36 (e.g., subcomponents) of the compressor 14. As a non-limiting example, the compressor components 36 may include a slide valve assembly of the compressor 14 and/or a balance piston assembly of the compressor 14 (e.g., in embodiments where the compressor 14 is a screw compressor), a variable geometry diffuser (VGD) of the compressor 14 (e.g., in embodiments where the compressor 14 is a centrifugal compressor), or any other suitable compressor components 36. As such, it should be understood that the control unit 32 may be operable to adjust an operational speed, a capacity, and/or other operational parameters or characteristics of the compressor 14.

The control unit 32 may be communicatively coupled to one or more sensors 40 of the HVAC&R system 10. The sensors 40 may be positioned near various components 36 of the compressor 14 and/or along the vapor compression system 16 and configured to acquire sensor feedback 42 indicative of operational parameters of the compressor 14 and/or of the vapor compression system 16. For example, the one or more sensors 40 may include temperature sensors, pressure sensors, proximity sensors, vibration sensors, acoustic sensors, and/or other suitable sensors configured to acquire feedback of various operational parameters of the HVAC&R system 10. Specifically, such operational parameters may include a suction pressure or temperature of the compressor 14, a discharge pressure or temperature of the compressor 14, a slide valve position of the compressor 14, a VGD position of the compressor 14, a temperature of the motor 26, a vibrational frequency or amplitude of a shaft of the compressor 14, inlet temperatures, outlet temperatures, inlet pressures, and/or outlet pressures at the evaporator 20 and/or the condenser 18, or other suitable parameters of the HVAC&R system 10. Indeed, as one of skill in the art would understand, the sensors 40 may be configured to acquire sensor feedback indicative of plurality of other operational parameters of the HVAC&R system 10 in addition to, or in lieu of, the exemplary parameters discussed above.

It should be understood that the HVAC&R system 10 may include a plurality of other components 41 in addition to, or in lieu of, the compressor 14, which may each include a dedicated control unit 43. Each of the control units 43 may include some of or all of the components of the control unit 32 and may be configured to control a respective component 41 of the HVAC&R system 10 in accordance with the techniques discussed herein. As a non-limiting example, the components 41 may include one or more evaporators, one or more condensers, one or more vessels, one or more pumps, one or more variable frequency drives (VFDs), one or more hygienic air units, one or more valves, and/or other suitable HVAC&R components. The control units 43 may be communicatively coupled to sensors 45 (e.g., some of the one or more sensors 40) configured to provide the control units 43 with feedback indicative of one or more operational parameters of the corresponding components 41. It should be appreciated that, although the cloud-based HVAC&R control system 12 is primary described below in the context of controlling the compressor 14, the techniques discussed herein may be used to control any one or combination of the components 41 via the cloud-based HVAC&R control system 12 in addition to, or in lieu of, the compressor 14.

In the illustrated embodiment, the cloud-based HVAC&R control system 12 includes a remote server 44 (e.g., one or more remote servers) that is communicatively coupled to the control unit 32 via a network 46 and a cloud 48 (e.g., a network interface for accessing one or more remote servers, virtual machines, etc., for storage, computing, or other functionality). As discussed below, the network 46 and the cloud 48, collectively referred to herein as a cloud network 50, enable the remote server 44 to receive the sensor feedback 42 acquired by the one or more sensors 40, to analyze the acquired sensor feedback 42 in accordance with a compressor control algorithm or scheme, and to generate a control output for adjusting operation of the compressor 14 based on results of the analyzed sensor feedback 42. Particularly, the remote server 44 may send the control output (e.g., a control signal) to the control unit 32 via the cloud network 50. As such, the control unit 32 may, based on the control output received from the remote server 44, send instructions to adjust the compressor components 36 of the compressor 14. In other embodiments, the remote server 44 may be configured to communicate directly with the compressor components 36 (e.g., via the cloud network 50), such that the remote server 44 may adjust operation of the compressor components 36 without input from the control unit 32. The remote server 44 may be disposed at a location that is remote from the compressor 14 (e.g., a server room or server farm).

In any case, as discussed in detail below, the cloud network 50 enables offloading of various computational processes that are typically performed on a control panel of the compressor 14 to the remote server 44. As such, the control unit 32 may include fewer hardware components (e.g., processing circuitry) and/or software modules than conventional compressor control panels, which may reduce a manufacturing cost and/or a manufacturing complexity of the control unit 32 (e.g., as compared to traditional compressor control panels). Moreover, as discussed below, the processing power of the remote server 44 may significantly exceed the processing power of typical compressor control panels and, thus, enable the remote server 44 to execute more sophisticated compressor control algorithms for controlling the compressor 14 (e.g., as compared to control algorithms that may be executed by traditional compressor control panels). Particularly, the remote server 44 may execute compressor control algorithms or schemes that enable a more comprehensive analysis of the sensor feedback 42 (e.g., as compared to a level of analysis performable by conventional compressor control panels) and therefore enable generation of control outputs that enhance compressor control and operation.

For clarity, as used herein, discussions relating to processing data, storing data, forming control outputs, or performing other operations "in the cloud 48" are intended to denote computational operations that may be performed by the remote server 44 configured to generate and provide the cloud 48. That is, as used herein, computational operations discussed as being performed "in the cloud 48" may refer to computational operations that are performed partially or completely by the server 44, instead of by processing components integrated with the HVAC&R components.

As shown in the illustrated embodiment, the remote server 44 may include communication circuitry 54, one or more processors 56, and one or more memory devices 58. The processors 56 may include microprocessors, which may execute software for analyzing the sensor feedback 42 in the cloud 48, as well as for controlling the compressor components 36 and/or any other suitable components of the HVAC&R system 10. The processors 56 may include multiple microprocessors, one or more "general-purpose" microprocessors, one or more special-purpose microprocessors, and/or one or more application specific integrated circuits (ASICS), or some combination thereof. For example, the processors 56 may include one or more reduced instruction set (RISC) processors. The memory devices 58 may include volatile memory, such as random access memory (RAM), and/or nonvolatile memory, such as read-only memory (ROM). The memory devices 58 may store information, such as control software (e.g., compressor control algorithms or schemes), look up tables, configuration data, communication protocols, etc.

For example, the memory devices 58 may store processor-executable instructions including firmware or software for the processors 56 execute, such as instructions for controlling any of the aforementioned components of the compressor 14 and/or components of HVAC&R system 10. In some embodiments, the memory devices 58 are tangible, non-transitory, machine-readable media that may store machine-readable instructions for the processors 56 to execute. The memory devices 58 may include ROM, flash memory, hard drives, any other suitable optical, magnetic, or solid-state storage media, or a combination thereof. The communication circuitry 54 facilitates communication between the remote server 44 and the control unit 32 via suitable communication channels 60 (e.g., wired and/or wireless connections). For example, in some embodiments, wired connections may be used to communicatively couple the control unit 32 to the network 46, while wireless communication channels (e.g., the cloud 48) may be used to communicatively couple the network 46 to the remote server 44.

In some embodiments, the network 46 includes a firewall 62 and/or a proxy that may be configured to regulate communication traffic across the network 46 and between the control unit 32 and the remote server 44. For example, the firewall 62 may be designed to block unauthorized access to the control unit 32 while permitting outward communication from the control unit 32 to the remote server 44.

In the illustrated embodiment, the cloud-based HVAC&R control system 12 includes a user interface 64 that may be communicatively coupled to the control unit 32, to the remote server 44, or both, via the cloud 48. The user interface 64 may include a portable computing system (e.g., laptop, cellular device) or other suitable system that enables an operator to view, modify, and/or control processes occurring on the cloud-based HVAC&R control system 12. Particularly, as discussed below, the user interface 64 may enable the operator to remotely monitor operational parameters of the compressor 14, to modify control schemes used to control the compressor 14, and/or to adjust operation of the compressor 14.

Figure 2:
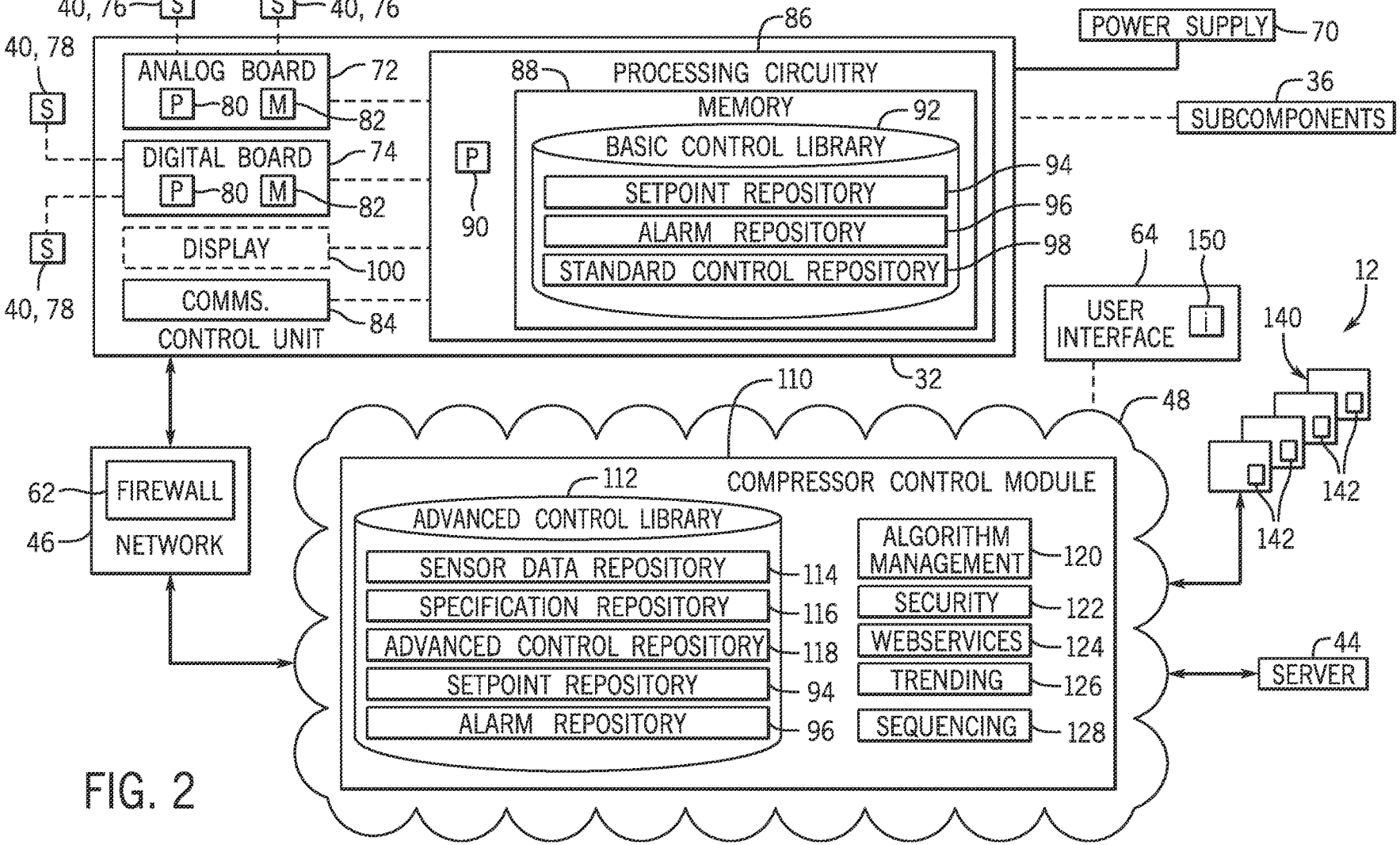
FIG. 2 is a schematic of an embodiment of a cloud-based HVAC&R control system for operating one or more components of an HVAC&R system, in accordance with an aspect of the present disclosure.

FIG. 2 is a schematic diagram of an embodiment of the cloud-based HVAC&R control system 12. The control unit 32 may be electrically coupled to a power supply 70 configured to provide electrical power to the control unit 32, the sensors 40, and/or other components of the compressor 14. In the illustrated embodiment, the control unit 32 includes an analog board 72 (e.g., a first processing board) or a plurality of analogy boards and a digital board 74 (e.g., a second processing board) or a plurality of digital boards configured to receive analog feedback and digital feedback, respectively, from the sensors 40. For example, the analog board 72 may be communicatively coupled to one or more analog sensors 76 (e.g., a subset of the sensors 40) configured to provide the analog board 72 with analog signals indicative of various operational parameters of the compressor 14. Particularly, the analog sensors 76 may provide the analog board 72 with feedback (e.g., real-time feedback) indicative of a discharge pressure and/or temperature of the compressor 14, a suction pressure and/or temperature of the compressor 14, oil pressures and/or temperatures at various locations along the compressor 14, a filter pressure of the compressor 14, a separator temperature of the HVAC&R system 10, a motor amperage drawn by the motor 26, and/or any other suitable operational parameters of the HVAC&R system 10. The digital board 74 may be communicatively coupled to one or more digital sensor 78 (e.g., a subset of the sensors 40) or other digital output devices configured to provide the digital board 74 with a status (e.g., a real-time status) of operational states (e.g., on/off) of certain compressor components 36. As an example, the digital sensors 78 may provide the digital board 74 with status signals indicating whether the compressor 14 is in an operational or idle state, whether an oil pump of the compressor 14 is in an operational or idle state, and/or whether oil level and/or liquid level faults are detected in the compressor 14.

In some embodiments, the analog board 72 and the digital board 74 may each include corresponding processors 80 and memory devices 82 that enable the boards 72, 74 to receive the sensor feedback 42 from the sensors 76, 78 and that facilitate transmission of the sensor feedback 42 to other components of the control unit 32 and/or to the cloud 48. For example, in some embodiments, the analog and digital boards 72, 74 are communicatively coupled to a communication component 84 of the control unit 32 that is configured to transmit the collected analog and digital sensor data to the cloud 48 (e.g., via the communication channels 60). Additionally, the analog and digital boards 72, 74 may be communicatively coupled to and configured to transmit at least a portion of the sensor feedback 42 to processing circuitry 86 (e.g., control circuitry) of the control unit 32. It should be appreciated that, in certain embodiments, the analog sensors 76, the digital sensors 78, or both, may be communicatively coupled directly to the processing circuitry 86, one or more of the control units 43, and/or the cloud 48. In such embodiments, the analog board 72, the digital board 74, or both, may be omitted from the control unit 32. As discussed below, the processing circuitry 86 may be configured to adjust certain operational parameters of the compressor 14 based on rudimentary or simplified analysis of at least a portion of the sensor feedback 42.

For example, the processing circuitry 86 may include a memory 88 and a processor 90 configured to execute instructions stored on the memory 88. The processor 90 may be communicatively coupled to at least a subset of the compressor components 36 and configured to adjust operation of these compressor components 36. The memory 88 may include a basic control library 92 that stores primitive or basic control routines or algorithms for controlling the compressor 14 and its components 36. The processor 90 may execute the primitive control routines or algorithms to analyze at least a portion of the sensor feedback 42 and to control the compressor 14 based on results of the analyzed sensor feedback 42.

For example, the basic control library 92 may include a setpoint repository 94 that stores upper and lower threshold values for various operating parameters of the compressor 14. Particularly, the setpoint repository 94 may store upper and lower threshold operating values for a compressor discharge temperature and/or pressure, a compressor suction temperature and/or pressure, and/or for any other suitable compressor parameters that may be monitored by the sensors 40.

The basic control library 92 may include an alarm repository 96 that includes alarm protocols relating to certain of the monitored compressor parameters. The alarm protocols may specify a type of alarm to be generated by the processor 90 in response to a determination that a particular operational parameter of the compressor 14 exceeds or falls below its corresponding upper and lower threshold values specified in the setpoint repository 94 for a predetermined time period. In other words, the alarm protocols may specify a particular alarm for the processor 90 to generate when one or more compressor parameters deviate from a corresponding acceptable operating range. For example, during compressor operation, the processor 90 may compare measured operational parameters of the compressor 14 to their corresponding upper and lower threshold values stored in the setpoint repository 94. Upon determining that an operational parameter or a plurality of operational parameters of the compressor 14 exceed or fall below their corresponding upper and lower threshold values specified in the setpoint repository 94 (e.g., for the threshold time period), the processor 90 may generate a particular type of alarm (e.g., audible, visual) in accordance with the alarm protocols stored in the alarm repository 96.

The basic control library 92 may also include a standard control repository 98 that includes basic control algorithms for analyzing the sensor feedback 42, or a portion of the sensor feedback 42, and for controlling the compressor 14 based on results of such analysis. For example, the processor 90 may execute the basic control algorithms to perform rudimentary analysis of at least a portion of the sensor feedback 42 and to generate a control output (e.g., output signals) for controlling the compressor 14 in accordance with results of such rudimentary analysis. As discussed below, the processor 90 may be configured to control the compressor 14 in accordance with the basic compressor control algorithms when a communication connection between the control unit 32 and the remote server 44 is interrupted. As a non-limiting example, when executed, the basic compressor control algorithms may enable the processor 90 to start or suspend operation of the compressor 14, to increase or decrease a capacity of the compressor 14, and/or to detect basic fault conditions of the compressor 14 based on analysis of the sensor feedback 42.

In some embodiments, the control unit 32 may include a display 100 configured to display the sensor feedback 42 acquired by the sensors 40 and/or to enable user access to the basic control library 92. For example, the display 100 may include an interactive interface configured to receive feedback from a user (e.g., an operator of the compressor 14) to enable the user to modify information (e.g., based on inputs sent from the interface of the display 100 to the control unit 32 and/or the remote server 44) in the basic control library 92 and/or to adjust operation of the compressor 14. In other embodiments, the display 100 may be omitted from the control unit 32 to reduce a manufacturing cost and manufacturing complexity associated with the control unit 32, as well as to enable compact manufacture of the control unit 32. Indeed, as discussed below, the user interface 64 may enable a user to view and/or modify the information in the basic control library 92, to view the sensor feedback 42, and/or to adjust operation of the compressor 14, such that the display 100 may be omitted from the control unit 32. As such, it should be understood that the user interface 64 enables the control unit 32 to be suitably mounted in spatially constrained areas of the compressor 14 and/or to a structure of the compressor 14 that is not readily accessible to a user, as the user need not physically access the control unit 32 to access the aforementioned features in the basic control library 92.

As briefly discussed above, the communication component 84 may be configured to direct some of or all of the sensor feedback 42 to the cloud 48. In some embodiments, a compressor control module 110 is configured for execution on the cloud 48 and to facilitate analysis of the sensor feedback 42 in accordance with one or more advanced compressor control algorithms stored in the cloud 48. For example, the compressor control module 110 may include an advanced control library 112 that stores various algorithms, routines, look-up tables, etc., which may be utilized by the remote server 44 to analyze the sensor feedback 42 and to generate control outputs (e.g., control signals) that facilitate efficient operation of the compressor 14. Specifically, in the illustrated embodiment, the advanced control library 112 includes a sensor data repository 114, a specification repository 116, and an advanced control repository 118. The sensor data repository 114 may store historical sensor data or current sensor data (e.g., the sensor feedback 42) acquired by the sensors 40. The specification repository 116 may store configuration data relating to various properties or characteristics of the HVAC&R system 10. As an example, the specification repository 116 may store refrigerant properties relating to the refrigerant used in the vapor compression system 16, operating specifications relating to the compressor 14 (e.g., a capacity range of the compressor 14), operating specifications relating the motor 26 (e.g., a power output range of the motor 26), and/or any other suitable operating specifications of the HVAC&R system 10.

The advanced control repository 118 may store advanced compressor control algorithms that may be retrieved and executed by the remote server 44 to analyze the sensor feedback 42. The advanced compressor control algorithms may enable the remote server 44 to evaluate the sensor feedback 42 at a finer granularity and/or higher sampling rate than a granularity and/or sampling rate at which the processor 90 is capable of analyzing the sensor feedback 42 via execution of the basic control algorithms stored in the basic control library 92.

For example, in some embodiments, the basic compressor control algorithms may enable the processor 90 to analyze a subset of the sensor feedback 42 at a first sampling rate (e.g., a relatively low sampling rate) to generate a first control output (e.g., output signals) for controlling the compressor 14 at a first efficiency level (e.g., a relatively low efficiency level). In contrast, the advanced compressor control algorithms may enable the remote server 44 to analyze all of the sensor feedback 42, or a larger portion of the sensor feedback 42 than the processor 90, at a second sampling rate (e.g., a relatively high sampling rate) to generate a second control output (e.g., control signals) for controlling the compressor 14 at a second efficiency level (e.g., a relatively high efficiency level).

Moreover, in certain embodiments, the advanced control repository 118 may include additional algorithms or routines for execution by the remote server 44 that are not included in the basic control library 92. As an example, the advanced control algorithms may include motor control algorithms, slide valve control algorithms, VGD control algorithms, VSD control algorithms, and/or various other auxiliary algorithms (e.g., algorithms for calculating subcooling and superheat values of the vapor compression system 16) that may not be included in the basic control library 92. Execution of these additional algorithms may enable the remote server 44 to operate the compressor 14 at an efficiency level that exceeds an efficiency level at which the processor 90 is capable of operating the compressor 14 using the basic compressor control algorithms stored in the basic control library 92. In some embodiments, the advanced control library 112 may also include the alarm repository 96 and/or the setpoint repository 94. As such, the remote server 44 may generate alarms in accordance with the alarm protocols discussed above when one or more compressor parameters deviate from corresponding target operational ranges (e.g., for a threshold duration of time).

In some embodiments, the compressor control module 110 may include an algorithm management module 120 that enables the remote server 44 to selectively control the compressor 14 based on one or more of the algorithms stored in the advanced control library 112. For example, in some embodiments, the algorithm management module 120 may select a particular control algorithm for execution by the remote server 44 based on a type (e.g., screw, centrifugal) of the compressor 14, based on a type of refrigerant used in the vapor compression system 16 (e.g., refrigerants such as hydrofluorocarbon (HFC) based refrigerants, for example, R-410A, R-407, R-134a, hydrofluoro olefin (HFO), "natural" refrigerants like ammonia (NH3), R-717, carbon dioxide (CO2), R-744, or hydrocarbon based refrigerants), or based on any other suitable parameter of combination of parameters of the HVAC&R system 10.

In some embodiments, the compressor control module 110 may include a security module 122 configured to restrict access to the cloud 48 or to various modules located on the cloud 48. For example, the security module 122 may cooperate with the firewall 62 to restrict access of unauthorized users to certain information and/or functionality of the cloud-based HVAC&R control system 12. In some embodiments, the compressor control module 110 may include a webservices module 124 that enables an operator to access the cloud 48 via an input device and/or display device, such as the user interface 64. The webservices module 124 may direct cloud access through the firewall 62 and, thus, enable the firewall 62 to block access to the compressor control module 110 by unauthorized personnel. In certain embodiments, the compressor control module 110 includes a trending module 126 that continuously or intermittently saves analog and digital input and/or output values to the cloud 48 and organizes this data in a manner that is accessible by various services (e.g., modules) included in the cloud 48. In some embodiments, the compressor control module 110 includes a sequencing module 128 that may coordinate operation of a group of compressors based on a capacity requirement or other parameter of the HVAC&R system 10.

Figure 3:
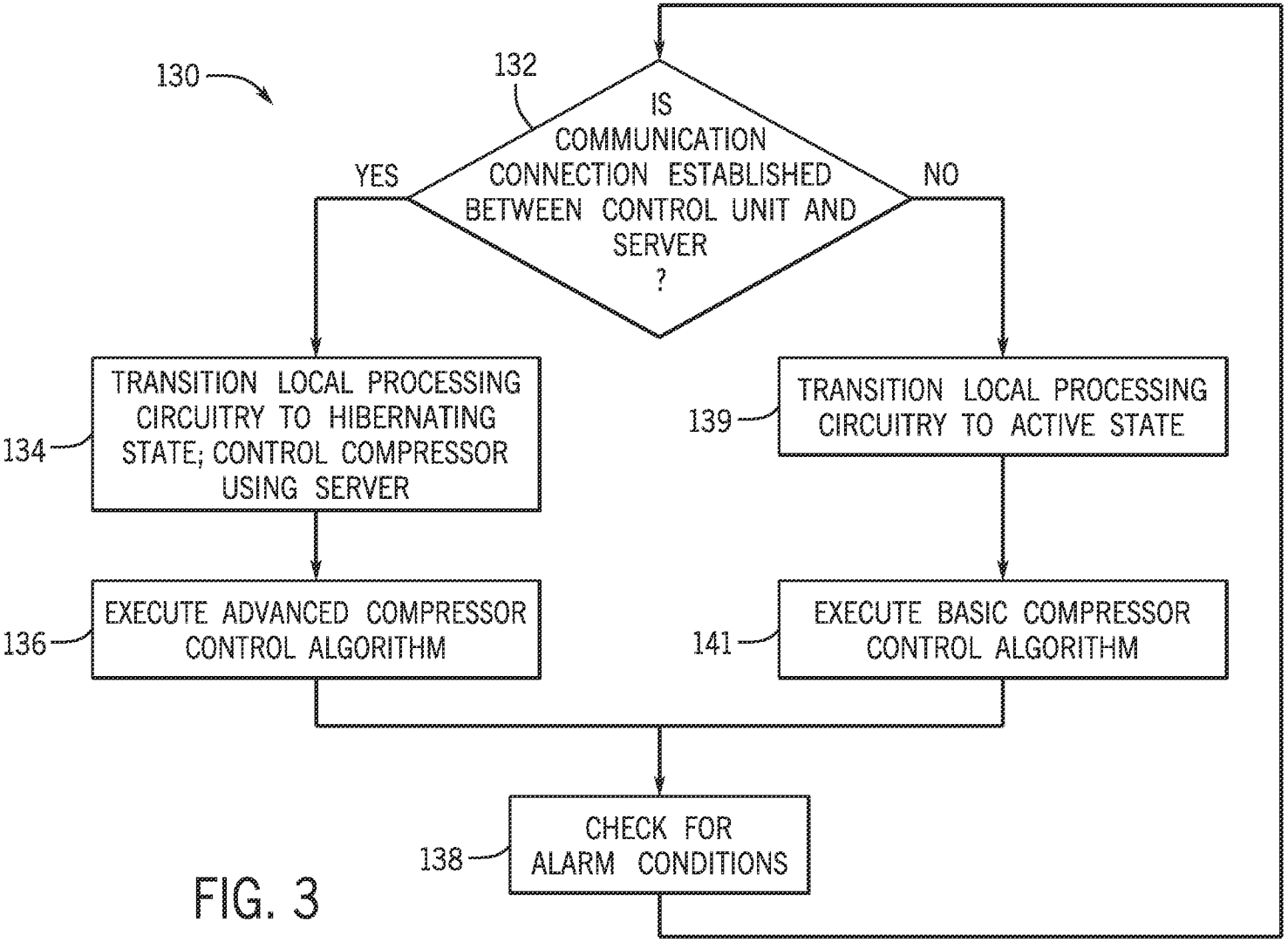
FIG. 3 is a flow diagram of an embodiment of a method of operating a compressor using a cloud-based compressor control system, in accordance with an aspect of the present disclosure.

FIG. 3 is a flow diagram of an embodiment of a method 130 for operating the compressor 14 using the cloud-based HVAC&R control system 12. It should be noted that the steps of the method 130 discussed below may be performed in any suitable order and are not limited to the order shown in the illustrated embodiment of FIG. 3. Moreover, it should be noted that additional steps of the method 130 may be performed and certain steps of the method 130 may be omitted. Still further, it should be appreciated that certain of the steps of the method 130 may be performed concurrently with other steps. The method 130 includes determining whether a communication connection or communication channel is established between the control unit 32 and the remote server 44 (e.g., between the control unit 32 and a module provided in the cloud 48, such as the compressor control module 110), as indicated by block 132. For example, in some embodiments, the processing circuitry 86 (e.g., the processor 90) of the control unit 32 may continuously or periodically monitor whether a communication connection is established between the communication component 84 of the control unit 32 and the cloud 48. As indicated by block 134, if the processing circuitry 86 determines that a communication connection is established between the control unit 32 and the remote server 44, the processing circuitry 86 may transition to a hibernating state in which the processing circuitry 86 does not control operation of the compressor 14, or in which the processing circuitry 86 controls a limited subset of operations of the compressor 14, while the remote server 44 controls all of or a majority of the operational aspects of the compressor 14. As such, it should be appreciated that, in certain embodiments, the processing circuitry 86 and the remote server 44 may collectively (e.g., concurrently) control operation of the compressor 14.

For example, in the hibernating state, the processing circuitry 86 may not analyze the sensor feedback 42 (e.g., using the basic compressor control algorithms). Instead, the sensor feedback 42 may be pushed to the cloud 48 and analyzed by the remote server 44 using the advanced compressor control algorithms stored in the advanced control library 112. As such, the remote server 44 may generate a control output to operate the compressor 14 in accordance with the advanced compressor control algorithms and at an elevated efficiency level, as indicated by block 136. As indicated by block 138, the remote server 44 may monitor the sensor feedback 42 to ensure that measured operational parameters of the compressor 14 do not exceed respective upper and/or lower threshold values specified in the corresponding alarm protocols (e.g., as derived from the alarm repository 96 and/or the setpoint repository 94). In some embodiments, the remote server 44 may generate an alarm upon a determination that a particular operational parameter of the compressor 14 exceeds corresponding upper or lower threshold values for at least a threshold period of time (e.g., 5 seconds).

In certain embodiments, the processing circuitry 86 may monitor and/or adjust certain operational parameters of the compressor 14 even when in the hibernating state. For example, when in the hibernating state, the processing circuitry 86 may monitor the sensor feedback 42, or a subset of the sensor feedback 42, in addition to, or in lieu of the remote server 44, to ensure that certain measured operational parameters of the compressor 14 do not exceed the respective upper and/or lower threshold values specified in the alarm protocols. As such, the remote server 44, the processing circuitry 86, or both, may be configured to generate an alarm when an operational parameter or a combination of operational parameters of the compressor 14 deviate from respective target operating ranges.

In some embodiments, if the processing circuitry 86 determines that the communication connection between the control unit 32 and the remote server 44 has been interrupted, the processing circuitry 86 may transition to an active state to establish control of the compressor 14, as indicated by block 139. For example, the processing circuitry 86 may transition to the active state upon a determination that the communication connection between the control unit 32 and the remote server 44 has been interrupted (e.g., continuously interrupted) for at least a first threshold time period. Additionally or alternatively, the processing circuitry 86 may transition to the active state upon a determination that a signal strength of the communication connection between the control unit 32 and the remote server 44 falls below a lower threshold value for a second threshold time period, which may be equal to or different than the first threshold time period.

Upon transitioning to the active state, the processing circuitry 86 may control the compressor 14 in accordance with the basic compressor control algorithms stored in the basic control library 92, as indicated by block 141. As such, the processing circuitry 86 may generate a control output that may cause the compressor 14 to operate at a standard efficiency level that may be less than an elevated efficiency level at which the compressor 14 may operate when controlled by the remote server 44. The processing circuitry 86 may again monitor the sensor feedback 42, or a subset of the sensor feedback 42, to ensure that measured operational parameters of the compressor 14 do not exceed the respective upper and/or lower threshold values specified in the alarm protocols, as indicated by the block 138. As such, the processing circuitry 86 may enable compressor operation even when the communication connection between the control unit 32 and the remote server 44 is interrupted. In some embodiments, the processing circuitry 86 may generate an alarm upon a determination that a particular operational parameter of the compressor 14 exceeds corresponding upper or lower threshold values for at least a threshold period of time (e.g., 5 seconds).

In some embodiments, the processing circuitry 86 and/or the remote server 44 may log (e.g., store) alarms that may be generated during compressor operation in the memory 88 and/or the cloud 48 (e.g., in a storage module of the alarm repository 96). In certain embodiments, a user may utilize the user interface 64 to view the alarms logged in the alarm repository 96 and/or to remotely clear the logged alarms. In some embodiments, the processing circuitry 86 and/or the remote server 44 may be configured to deactivate the compressor 14 if a logged alarm remains uncleared for at least a threshold time period.

When in the active state, the processing circuitry 86 may continuously or periodically evaluate whether the communication connection between the control unit 32 and the remote server 44 is re-established. In some embodiments, the processing circuitry 86 may release control of the compressor 14 to the remote server 44 and return to the hibernating state upon a determination that the communication connection between the control unit 32 and the remote server 44 has been re-established for at least the first threshold time period. Additionally or alternatively, the processing circuitry 86 may release control of the compressor 14 to the remote server 44 upon a determination that the signal strength of the communication connection between the control unit 32 and the remote server 44 exceeds the lower threshold value for the second threshold time period. As such, the remote server 44 may resume control of the compressor 14 in accordance with the advanced compressor control algorithms stored in the advanced control library 112. As discussed above, in certain embodiments, the processing circuitry 86 and the remote server 44 may collectively (e.g., concurrently) control operation of the compressor 14. As an example, in such embodiments, the processing circuitry 86 may control the compressor 14 in accordance with at least a portion of the basic compressor control algorithm and the remote server 44 may concurrently control the compressor 14 in accordance with at least a portion of the advanced compressor control algorithm.

The following discussion continues with reference to FIG. 2. In some embodiments, the user interface 64 enables a user (e.g., an operator of the compressor 14) to access the compressor control module 110 (e.g., via instructions sent to the remote server 44) and to modify information included in the advanced control library 112 or other modules of the compressor control module 110. For example, the user may modify the advanced compressor control algorithms stored in the advanced control library 112 to incorporate software updates to the control algorithms or to add additional control algorithms to the advanced control repository 118.

In some embodiments, the compressor control module 110 may be configured to control operation of a plurality of additional compressors 140 that are communicatively coupled to the cloud 48. For example, each of the additional compressors 140 may include a corresponding control unit 142 that includes some of or all of the features of the control unit 32 discussed above. In some cases, when the control units 32, 142 are communicatively coupled to the cloud 48, the remote server 44 may be configured to control each of the compressors 14, 140 in accordance with the control algorithms of the advanced control library 112. Thus, by accessing the advanced control library 112 (e.g., via the user interface 64), the user may quickly and easily update the control algorithms used for operating several or all of the compressors 140, without having to individually update software code on the various control units 32, 142. To this end, the user may utilize the user interface 64 to simultaneously update the control algorithms used to control operation of the compressors 14, 140 or of a designated subset of the compressors 14, 140, without physically traveling to one or more locations of the compressors 14, 140. In other words, the user may, via the user interface 64, remotely adjust control algorithms used to operate any of the compressors 14, 140 communicatively coupled to the cloud 48. Moreover, the user may utilize the user interface 64 to modify the corresponding specification repository 116 associated with each of the additional compressors 140 and/or to update any other information on the cloud 48 relating to the additional compressors 140. In some embodiments, a user may, via inputs received via the user interface 64, selectively enable or disable certain functionality of any of the compressors 14, 140. Accordingly, the user may remotely tailor functionality of the individual compressors 14, 140 based on customer specifications and/or a jobsite in which the compressors 14, 140 are to be implemented.

In some embodiments, the user may utilize the user interface 64 to access the cloud 48 to individually view and/or modify information related to each of the compressors 14, 140. For example, each of the compressors 14, 140 may be displayed on the user interface 64 as a user-selectable icon 150. Upon selection of the corresponding icon 150, the user may view and/or modify information stored in the basic control library 92 of the control unit 32, 142 of a particular compressor 14, 140 and/or in the compressor control module 110 associated with a particular compressor 14, 140. As another example, the user may utilize the user interface 64 to view real-time sensor feedback 42 pushed to the cloud 48 by the analog and digital boards 72, 74 of a corresponding compressor control unit 32, 142, to transition the processing circuitry 86 of a particular compressor 14, 140 between the hibernating and the active state, or to perform another suitable action. In some embodiments, the could-based HVAC&R system 12 may include an additional user interface (e.g., a diagnostic user interface) that may include advanced functionality, as compared to the user interface 64. Particularly, the additional user interface may be operable to facilitate initial set up or installation of a particular compressor 14, 140 and its communication with the cloud 48.

In certain embodiments, the user interface 64 may include an augmented reality device (e.g., a head mounted display) configured to be worn by the user during an inspection of a particular compressor, such as the compressor 14. In such embodiments, the user interface 64 may be configured to overlay real-time operational data or other information relating to the compressor 14 onto a field of view of the user. As a non-limiting example, upon a detection that the user is viewing the motor 26 of the compressor 14, the user interface 64 may be configured to overlay a real-time operating temperature of the motor 26, a real-time amperage draw of the motor 26, or motor specifications (e.g., a motor horsepower) onto the field of view of the user.

As set forth above, embodiments of the present disclosure may provide one or more technical effects useful for reducing a manufacturing cost and complexity of compressor control panels. In particular, the disclosed cloud-based HVAC&R control system enables traditional compressor control panels to be replaced with simplified and more economical control units including fewer components than the traditional compressor control panels. Moreover, the disclosed cloud-based HVAC&R control system enables execution of advanced compressor control algorithms via a remote server that are tailored to enhance an operational efficiency of a compressor. Indeed, the cloud-based HVAC&R control system enables utilization of more advanced and/or complex analysis, processing, and control of the compressor that traditional compressor control panels are unable to perform. It should be understood that the technical effects and technical problems in the specification are examples and are not limiting. Indeed, it should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. § 112(f).

The invention claimed is:

1. A heating, ventilation, air conditioning, and/or refrigeration (HVAC&R) system, comprising:

one or more sensors configured to acquire feedback indicative of an operational parameter of a component of the HVAC&R system;

a control unit of the component configured to receive the feedback from the one or more sensors, wherein the control unit is configured to analyze the feedback at a first sampling rate in accordance with a first control scheme stored in a first control library of the control unit to generate a first control output and to operate the component based on the first control output; and a remote server configured to provide a cloud computing environment, wherein the remote server is configured to communicatively couple to the control unit via a network, and wherein the remote server is configured to receive and analyze the feedback at a second sampling rate in accordance with a second control scheme stored in a second control library of the remote server, instead of the first control scheme, to generate a second control output and to operate the component based on the second control output, instead of the first control output, wherein the first control scheme is different from the second control scheme, and the second sampling rate is greater than the first sampling rate.

2. The HVAC&R system of claim 1, wherein the component comprises a compressor, an evaporator, a condenser, a vessel, a pump, a variable frequency drive (VFD), a hygienic air unit, a valve, or a combination thereof.

3. The HVAC&R system of claim 1, wherein the control unit is configured to determine whether a communication channel is established between the control unit and the remote server and, upon a determination that the communication channel is established, transition to a hibernating state while the remote server controls the component based on the second control output.

4. The HVAC&R system of claim 3, wherein, upon a determination that the communication channel between the control unit and the remote server is interrupted, the control unit is configured transition to an active state to control the component based on the first control output.

5. The HVAC&R system of claim 1, wherein the control unit and the remote server are configured to concurrently control operation of the component based on a portion of the first control scheme and a portion of the second control scheme.

6. The HVAC&R system of claim 1, wherein the control unit is coupled to a structure of the component, and the remote server is disposed at a location remote from the component.

7. The HVAC&R system of claim 1, comprising a user interface communicatively coupled to the control unit, the remote server, or both, via the network.

8. The HVAC&R of claim 7, wherein the user interface is configured to receive a user input and, based on the user input, send instructions to modify the second control scheme.

9. The HVAC&R system of claim 7, wherein the user interface is configured to display the feedback acquired by the one or more sensors.

10. The HVAC&R of claim 1, comprising a plurality of additional HVAC&R components having a plurality of additional control units, wherein each additional control unit of the plurality of additional control units is configured to control a corresponding additional HVAC&R component of the plurality of additional HVAC&R components in accordance with a respective first control scheme, and wherein the remote server is configured to operate each additional HVAC&R component of the plurality of additional HVAC&R components in accordance with a respective second control scheme.

11. A method for operating a heating, ventilation, air conditioning, and/or refrigeration (HVAC&R) system, comprising:

acquiring feedback indicative of an operational parameter of a component of the HVAC&R system via one or more sensors of the HVAC&R system;

determining whether to control the component in accordance with a first control scheme or a second control scheme based on a status of a communication channel between a control unit of the component and a remote server of the HVAC&R system;

in response to determining that the communication channel between the control unit and the remote server is interrupted, analyzing the feedback at a first sampling rate via the control unit and in accordance with the first control scheme stored in a first control library of the control unit to generate a first control output for operating the component based on the first control scheme; and in response to determining that the communication channel between the control unit and the remote server is established, analyzing the feedback at a second sampling rate via the remote server and in accordance with the second control scheme stored in a second control library of the remote server, instead of the first control scheme, to generate a second control output for operating the component based on the second control scheme instead of based on the first control scheme, wherein the first control scheme is different from the second control scheme, and the second sampling rate is greater than the first sampling rate.

12. The method of claim 11, comprising, in response to determining that the communication channel is established, controlling operation of the component based on a portion of the first control scheme and a portion of the second control scheme.

13. The method of claim 11, comprising:

in response to determining that the communication channel is established, transitioning the control unit to a hibernating state and generating the second control output via execution of the second control scheme by the remote server; and in response to determining that the communication channel is interrupted, transitioning the control unit to an active state and generating the first control output via execution of the first control scheme by the control unit.

14. The method of claim 11, comprising:

receiving, via a user interface of the HVAC&R system, a user input from a user of the HVAC&R system; and modifying, based on the user input, the first control scheme, the second control scheme, or both.

15. The method of claim 11, wherein determining that the communication channel is interrupted comprises:

determining that the communication channel between the control unit and the remote server has been continuously interrupted for at least a first threshold time period; or determining that a signal strength of the communication channel is below a threshold value for a second threshold time period; or both.

16. A heating, ventilation, air conditioning, and/or refrigeration (HVAC&R) system, comprising:

a plurality of control units configured to control operation of respective components of a plurality of components of the HVAC&R system, wherein the plurality of control units is configured to receive sensor feedback and analyze the sensor feedback at a first sampling rate in accordance with respective first control schemes stored in respective first control libraries of the plurality of control units to generate respective first control outputs for controlling the respective components based on the respective first control schemes; and a remote server configured to provide a cloud computing environment, wherein the remote server is configured to communicatively couple to the plurality of control units via a network, and wherein the remote server is configured to receive the sensor feedback and analyze the sensor feedback at a second sampling rate in accordance with a second control scheme stored in a second control library of the remote server for a component of the plurality of components, instead of the respective first control scheme corresponding to the component, to generate a second control output for controlling the component of the plurality of components based on the second control scheme instead of based on the respective first control scheme corresponding to the component, wherein the respective first control schemes are different from the second control scheme, and the second sampling rate is greater than the first sampling rate.

17. The HVAC&R system of claim 16, comprising a user interface communicatively coupled to the cloud computing environment via the network and configured to receive a user input, wherein the plurality of control units is configured to receive the user input via the network and adjust the respective first control schemes based on the user input.

18. The HVAC&R system of claim 17, wherein the remote server is configured to receive an additional user input from the user interface via the network and to adjust the second control scheme based on the additional user input.

19. The HVAC&R system of claim 16, wherein a first control unit of the plurality of control units corresponding to a first component of the plurality of components is configured to determine whether a communication channel is established between the first control unit and the remote server and, upon a determination that the communication channel is established, transition to a hibernating state while the remote server controls the first component based on the second control output.

20. The HVAC&R system of claim 19, wherein, upon a determination that the communication channel between the first control unit and the remote server is interrupted, the first control unit is configured transition to an active state to control the first component based on the respective first control output corresponding to the first control unit.

* * * * *